US011234316B2

(12) United States Patent
Cao et al.

(10) Patent No.: US 11,234,316 B2
(45) Date of Patent: Jan. 25, 2022

(54) LIGHTING APPARATUS

(71) Applicant: XIAMEN ECO LIGHTING CO. LTD., Xiamen (CN)

(72) Inventors: Liangliang Cao, Xiamen (CN); Hongkui Jiang, Xiamen (CN); Yuxin Huang, Xiamen (CN); Dejuan Liang, Xiamen (CN); Yuankai You, Xiamen (CN); Fujie Chen, Xiamen (CN)

(73) Assignee: XIAMEN ECO LIGHTING CO. LTD., Fujian (CN)

( * ) Notice: Subject to any disclaimer, the term of this patent is extended or adjusted under 35 U.S.C. 154(b) by 0 days.

(21) Appl. No.: 16/852,468

(22) Filed: Apr. 18, 2020

(65) Prior Publication Data

US 2021/0329766 A1 Oct. 21, 2021

(51) Int. Cl.

| | |
|---|---|
| ***H05B 47/155*** | (2020.01) |
| ***F21V 5/04*** | (2006.01) |
| ***F21V 31/00*** | (2006.01) |
| ***F21Y 115/10*** | (2016.01) |

(52) U.S. Cl.

CPC ..... *H05B 47/155* (2020.01); *F21V 5/048* (2013.01); *F21V 31/005* (2013.01); *F21Y 2115/10* (2016.08)

(58) Field of Classification Search

CPC . F21K 9/232; F21K 9/233; F21K 9/61; F21K 9/235; F21K 9/237; F21K 9/238; F21K 9/64; G02B 27/0955; G02B 19/0028; G02B 19/0061; G02B 19/0014; G02B 19/0066; G02B 27/0994; G02B 27/425; G02B 6/0001; G02B 6/0011; G02B 6/002; G02B 6/0021; G02B 6/0025; G02B 6/0068; G02B 6/0073; G02B 6/0076; G02B 6/0095; G02B 6/4236; H05B 45/00; H05B 45/357; F21V 23/003; F21V 23/06; F21V 29/70; F21V 17/04; F21V 19/001; F21V 23/004; F21V 29/77; F21V 29/773; F21V 5/04; F21V 5/045; F21V 7/0091

See application file for complete search history.

(56) References Cited

U.S. PATENT DOCUMENTS

| | | | | |
|---|---|---|---|---|
| 2018/0087759 | A1* | 3/2018 | Mathews | F21K 9/232 |
| 2019/0320515 | A1* | 10/2019 | Sadwick | H05B 45/00 |
| 2020/0232611 | A1* | 7/2020 | Raring | G02B 6/0006 |

* cited by examiner

*Primary Examiner* — Monica C King

(74) *Attorney, Agent, or Firm* — Chun-Ming Shih; Lanway IPR Services

(57) ABSTRACT

A lighting apparatus includes a lens module, a light source plate, a first set of LED modules ad a second set of LED modules, and a driver. The first set of LED modules are located at first positions of the light source plate. The second set of LED modules are located at second positions of the light source plate. The driver controls the first set of LED modules and the second set of LED modules for generating a first output light pattern and a second output light pattern. The first light pattern and the second light pattern are mixed to generate one of multiple projected shapes on a projected surface controlled by the driver.

19 Claims, 12 Drawing Sheets

LIGHTING APPARATUS

FIELD

The present application is related to a lighting apparatus and more particularly related to a lighting apparatus with adjustable light shapes.

BACKGROUND

Electroluminescence, an optical and electrical phenomenon, was discover in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

SUMMARY

In some embodiments, a lighting apparatus includes a lens module, a light source plate, a first set of LED modules ad a second set of LED modules, and a driver.

The first set of LED modules are located at first positions of the light source plate. The second set of LED modules are located at second positions of the light source plate.

The driver controls the first set of LED modules and the second set of LED modules for generating a first output light pattern and a second output light pattern. The first light pattern and the second light pattern are mixed to generate one of multiple projected shapes on a projected surface controlled by the driver.

In some embodiments, the multiple projected shapes have different diameters.

In some embodiments, when the multiple projected shapes are different, an overall power out of the first set of LED modules and the second set of LED modules is kept substantially the same.

In some embodiments, the second set of LED modules surround the first set of LED modules, the projected shape is decreased by turning off the second set of LED modules.

In some embodiments, a luminance level ratio between the first set of LED modules and the second set of LED modules is different providing different projected light patterns.

In some embodiments, the driver controls only a portion of the first set of LED modules together with a portion of the second set of LED modules to emit light for providing a projected light pattern different from turning on all of the first set of LED modules and all of the second set of LED modules.

In some embodiments, the second set of LED modules are detachably attached to the first set of LED modules.

In some embodiments, the lighting apparatus may also include a manual switch for controlling the driver to change the projected light shapes.

In some embodiments, the manual switch is positioned between a first housing and second housing of the lighting apparatus and operated by rotating the first housing with respect to the second housing.

In some embodiments, multiple rotation patterns between the first housing and the second housing provide different settings for the driver to control the first set of LED modules and the second set of LED modules.

In some embodiments, there is a triggering structure for switch a jumper on the driver when the first housing is rotated with respect to the second housing.

In some embodiments, the manual switch is adjusted when a first housing is shifted with respect to a second housing of the lighting apparatus.

In some embodiments, the lighting apparatus may also include a lens having a first lens portion facing to the first set of LED modules and a second lens portion facing to the second set of LED modules, the first lens portion and the second lens portion having different optical parameters.

In some embodiments, the lens is a TIR lens.

In some embodiments, the first lens portion and the second lens portion provide different refraction angles respectively for the first set of LED modules and the second set of LED modules.

In some embodiments, the driver controls the first set of LED modules and the second LED modules to turn off for rest for a period of time alternatively to prevent overheating of the first set of LED modules and the second set of LED modules.

In some embodiments, the first set of LED modules and the second of LED modules use different heat sinks to perform heat dissipation separately.

In some embodiments, the lighting apparatus may also include a water proof housing for enclosing the driver, the first set of LED modules and the second set of LED modules, wherein the lens module is plugged to the water proof housing and replaceable with another lens module to another lens module.

In some embodiments, the lighting apparatus may also include a distance detector, wherein the driver uses the distance detector to measure a distance between the lighting apparatus to the projected surface and uses the distance to determine how to control the first set of LED modules and the second set of LED modules.

DETAILED DESCRIPTION

Figure 7:
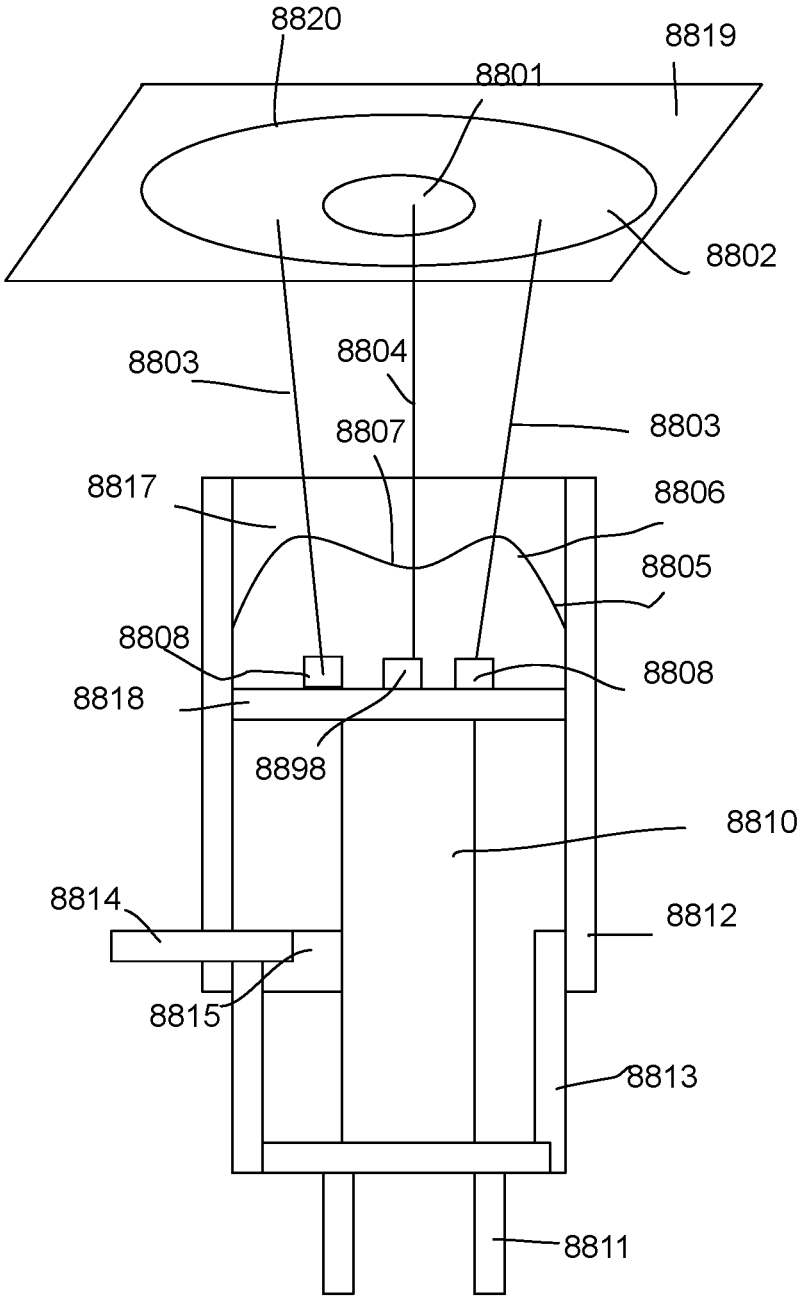
FIG. 7 illustrates a structure of an embodiment.

In FIG. 7, a lighting apparatus includes a lens module 8817, a light source plate 8818, a first set of LED modules 8898 and a second set of LED modules 8808, and a driver 8810.

The first set of LED modules 8898 are located at first positions of the light source plate 8818. The second set of LED modules 8808 are located at second positions of the light source plate 8818. In this example, the second set of LED modules 8808 surround the first set of LED modules 8898. Specifically, the first set of LED modules 8898 are arranged as a rectangular or circular shape while being surrounded by the second set of LED modules 8808.

The driver 8810 controls the first set of LED modules 8898 and the second set of LED modules 8808 for generating a first output light pattern 8801 and a second output light pattern 8802. The first light pattern 8801 and the second light pattern 8802 are mixed to generate one of multiple projected shapes 8820 on a projected surface 8819 controlled by the driver 8810. Specifically, the driver 8810 selectively turns on or turn off completely or partially the first set of LED modules 8898 and the second set of LED modules 8808 forming different projected shapes 8820. More details are explained in following examples.

A PAR light is a lighting device. The PAR light has fixed light beam angle to create fixed light pattern. The PAR light is used in commercial lighting, stage lighting, and so on.

Conventional PAR light mostly uses halogen lamp. With the development of the LED technology, LED light source replaces the halogen tungsten light source in the conventional PAR light.

But most of the PAR light now has single beam angle. Therefore, there are some limitation in actual situations. In other words, the PAR light now has narrow range of application.

If there is a need to switch angle in one situation, different PAR lights with different angles are needed, which causes a huge burden on cost. Other than that, due to the limitation of the situation, the PAR light with water proof effect would be better.

There is a lighting apparatus to fix the problems that conventional PAR light can't change the light emitting angle and has bad water proof effect.

In some embodiments, the lighting apparatus includes a lens and a light source unit in the lens.

The lens is a TIR lens. A TIR lens works on the principle of total internal reflection. When light reaches an interface between two materials with different refractive indices and the correct angle of incidence, there is refraction (bending of a light ray from its original path).

As light travels from a medium with a higher refractive index to that with a lower refractive index, Snell's law requires the angle at which the light ray gets refracted to be greater than 90 degrees. For angles of incidence exceeding a certain angle, the light is reflected into the material. The angle for which this occurs is called the critical angle and the phenomenon is called total internal reflection There is no associated loss of power in TIR. meaning a TIR is the most efficient way of reflecting light. The design of a TIR lens therefor takes advantage of this physics principal.

The light source unit includes multiple sets of light sources disposed on a base plate. The multiple sets of light sources are disposed from center to peripheral. The light apparatus includes a light emitting control module.

The light emitting control module is set for controlling the light emitting status of the multiple sets of light sources.

Preferably, the light emitting control module includes a controller and a wireless communication module connected to the controller. The wireless communication module is for receiving external control signals.

The wireless communication module is connected to an external remote control or a smart terminal to control the light emitting status of the multiple sets of light sources. The lighting apparatus is easy to operate and use and intelligent.

Preferably, the light emitting control module includes a controller. The controller is connected to a multi-position selective switch on the outside of the lighting apparatus with wiring.

With common multi-position selective switch and wiring, switching and installing are easier. The structure change of the lighting apparatus is not big, and the lighting apparatus has water proof effect.

Preferably, the lighting apparatus includes a housing fixed to the lens and a driver in the housing.

The light emitting control module is fixed on the driver. The housing guarantees the beauty of the appearance and the heat dissipation function.

Preferably, the light emitting control module includes a controller and a switch module connected to the controller.

The lighting apparatus includes the switch module to switch the light emitting angle of the lighting apparatus.

Preferably, the housing includes a first housing and a second housing. The first housing and the second housing are rotatably connected.

Changing the relative position of the first housing and the second housing may change the light emitting angle of the lighting apparatus, which is easy to operate.

Preferably, the switch module includes a knob switch module. The knob switch module is set between the first housing 31 and the second housing. And the switch position may be changed with the rotation between the first housing 31 and the second housing.

Then the luminance levels of the multiple sets of light sources may be switched by changing the switch position of the knob switch module.

Preferably, there is a water proof unit between the first housing.

The water proof unit may use a water proof ring to water proof the first housing and the second housing and to avoid the water from getting into the lighting apparatus and affecting the device.

Preferably, the switch module includes a push-button switch module or a toggle switch module. The button of the push-button switch module or the toggle of the toggle switch module may be fixed on the housing. Then the luminance levels of the multiple sets of light sources may be changed by using the button or the toggle to switch among different switch positions.

Preferably, the center of the multiple sets of light sources is set to be a circular light source that is tightly arranged with minimum diameter. The circular light source gradually expands from the center to the multi-circle light source on the peripheral to control the luminance level of the multi-circle light source and the light emitting angle of the lighting apparatus.

Preferably, the multiple sets of light sources include an inner circular light source, a middle circular light source, and an outer circular light source disposed in concentric circles.

There are at least three ways of illuminating. In the first way, the luminance level of the inner circular light source is 100%. The luminance level of the middle circular light source and the outer circular light source is 0%. In the second way, the luminance level of the inner circular light source is 28%. The luminance level of the middle circular light source is 72%. The luminance level of the outer circular light source is 0%. In the third way, the luminance level of the inner circular light source is 13%. The luminance level of the middle circular light source is 26%. The luminance level of the outer circular light source is 61%.

These three ways of illuminating and the reflection of the TIR lens make switching among three or multiple angles of the lighting apparatus with only one TIR lens happen.

In some embodiments, the lighting apparatus includes a lens and a light source unit inside of the lens. The lends is a TIR lens. The light source unit includes multiple sets of light sources disposed on a base plate. The multiple sets of light sources are disposed from the center to the peripheral. The lighting apparatus also includes a light emitting control module.

The light emitting control module is set for controlling the light emitting status of each set of the multiple sets of light sources. Adjusting the light emitting status of the multiple sets of light sources in one TIR lens of the lighting apparatus makes switching among different angles happen. Then, the lighting apparatus may be applicable to multiple situations.

The appearance of the lens of the lighting apparatus is as the same as the conventional PAR light. The lens of the lighting apparatus looks like the single-lens TIR lens. The acceptability is higher.

Other than that, the lighting apparatus has multiple control methods to switch the luminance level of the multiple sets of light sources and the light emitting angle of the lighting apparatus. The lighting apparatus is easy to operate and convenient. And the cost of the situations that need multiple angles is lower.

Also, the lighting apparatus has good water proof effect. And the lighting apparatus is applicable to many situations and very reliable.

In FIG. 1 to FIG. 6, a lighting apparatus includes a lens 1, a light source unit 2 inside of the lens 1, a housing 3 fixed to the lens 1, and a driver 4 in the housing 3. Other than that, the lens 1 is a TIR lens.

The light passing through the TIR lens may be totally reflected in a certain angle. The light source unit 2 includes multiple sets of light sources 22 disposed on a base plate 21.

The multiple sets of light sources 22 are disposed from the center to the peripheral. Also, each set of the multiple sets of light sources 22 may be controlled individually.

The lighting apparatus includes a light emitting control module 5.

The light emitting control module 5 is set for controlling the light emitting status of each set of the multiple sets of light sources 22, and the light emitting control module 5 is set on the driver 4.

Therefore, by controlling the light emitting status of the multiple sets of light sources 22 and combining with the reflection of the TIR lens, the lighting apparatus may have different light emitting angles. The luminance level of the multiple sets of light sources in outer circle is higher, and the light emitting angle of the lighting apparatus is bigger.

In other embodiments, changing the structure of the lens 1 and switching the light emitting status of the multiple sets of light sources may lead to different light emitting angles.

In preferable embodiment, the lighting apparatus includes a heat dissipation unit 6. The light source unit 2 is fixed with on end of the heat dissipation unit 6.

To be specific, the light source 2 and the heat dissipation unit 6 may be connected with screws. The driver 4 is fixed with the other end of the heat dissipation unit 6.

Installing the heat dissipation unit 6 in the housing 3 causes thermal contact with the housing 3.

The heat dissipation unit 6 and the housing have good heat dissipation.

The preferable material is aluminum. Therefore, the housing 3 may guarantee the beauty of the appearance and have good heat dissipation function at the same time.

There are three embodiments to explain how to control the light emitting status of the multiple sets of light sources 22.

Figure 1:
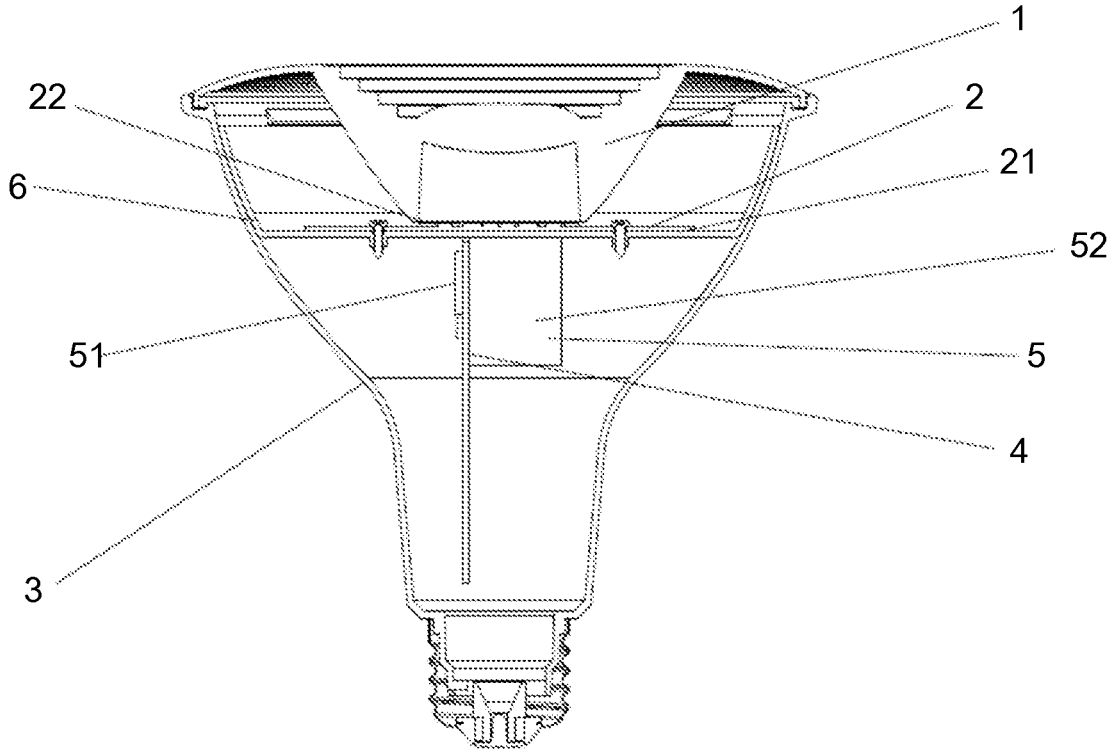
FIG. 1 is a cross sectional view of a lighting apparatus in a first embodiment.
Figure 2:
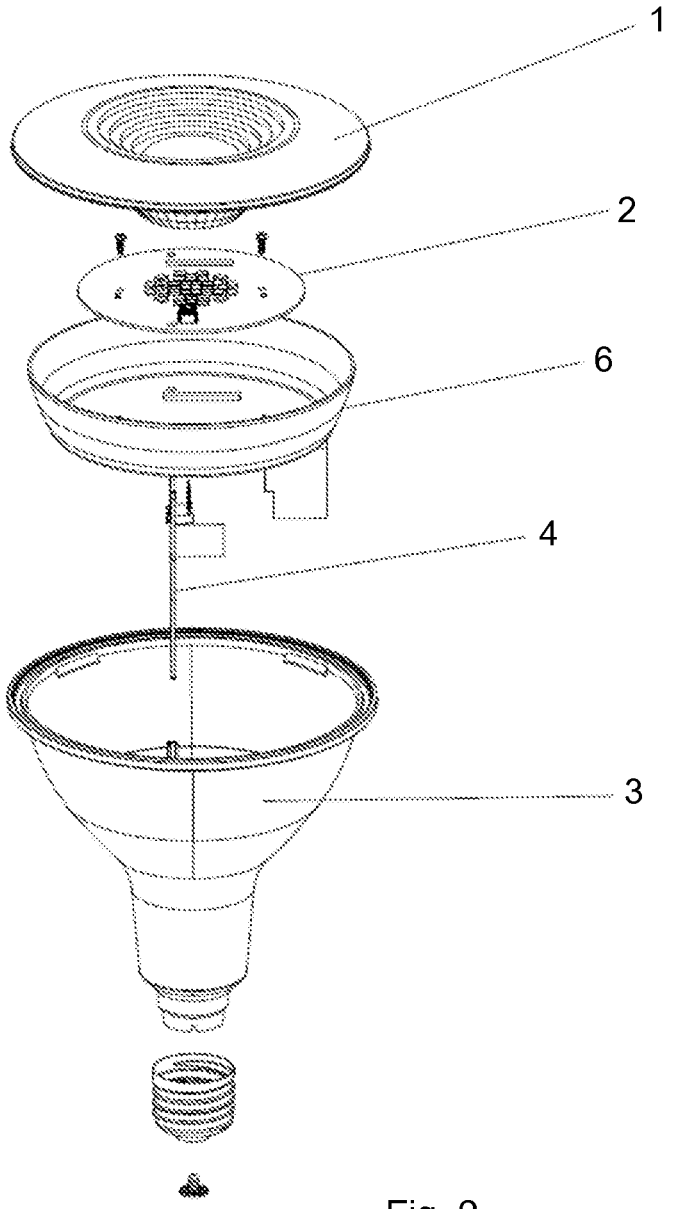
FIG. 2 an exploded view of the lighting apparatus in the first embodiment.

In the first embodiment, as illustrated in FIG. 1 and FIG. 2, the light emitting control module 5 includes a controller 51 and a wireless communication module 52 connected to the controller 51.

The wireless communication module 52 is connected to an external remote control or a smart terminal.

The wireless communication module 52 controls the light emitting status of the multiple sets of light sources 22 by using the button of the external remote control or the APP on the smart terminal.

The wireless communication module 52 includes one or more of WIFI, GPRS, WCDMA, CDMA2000, TD-SCD-MAMA, 4 GLTE, Bluetooth, BLE, Zigbee, and Zigwave.

Figure 3:
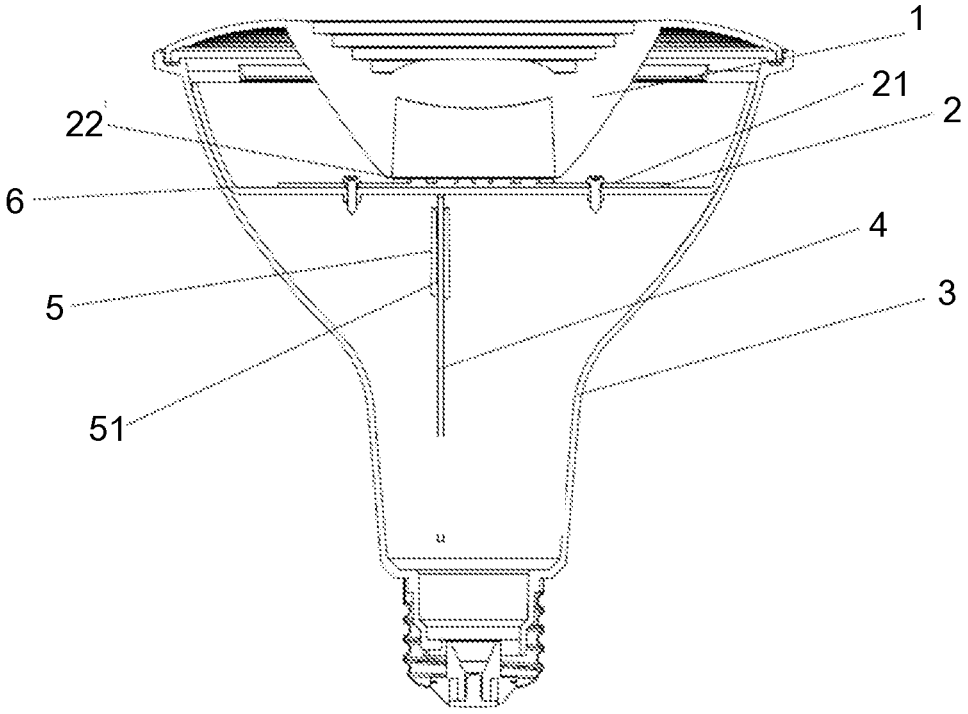
FIG. 3 a cross sectional view of the lighting apparatus in a second embodiment.
Figure 4:
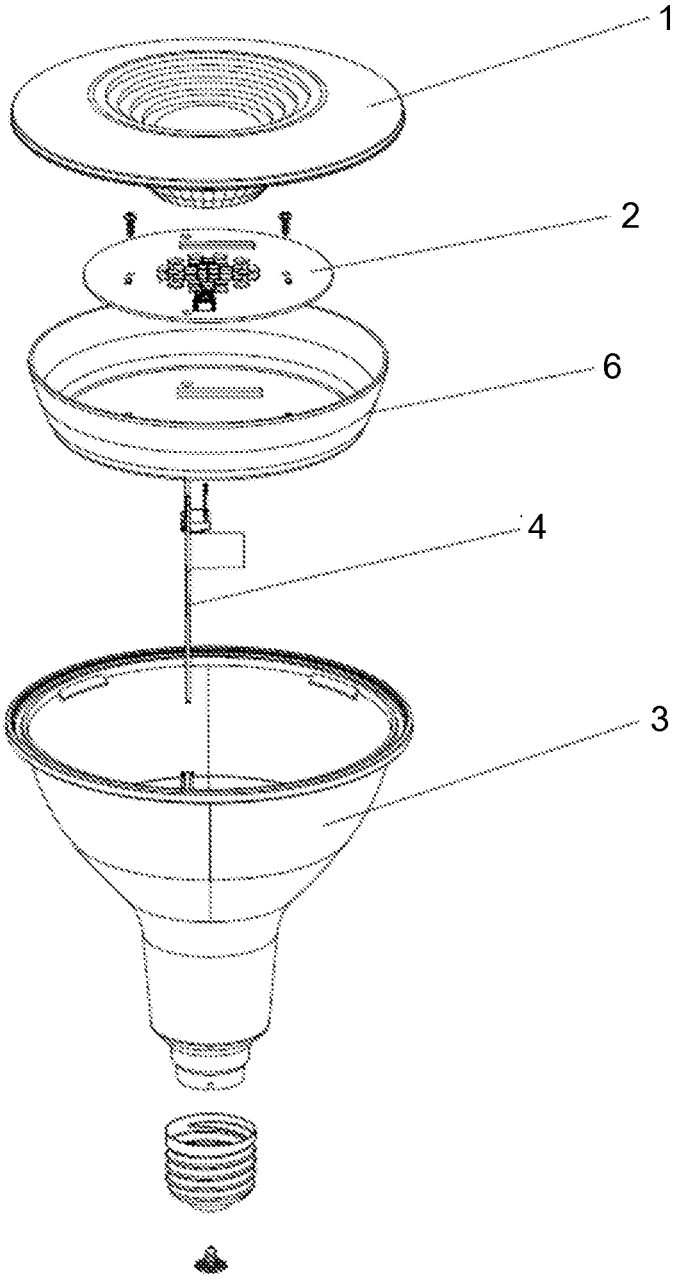
FIG. 4 is an exploded view of the lighting apparatus in the second embodiment.

In the second embodiment, as illustrated in FIG. 3 and FIG. 4, the light emitting control module 5 includes a controller 51.

The controller 51 is connected to the multi-position selective switch on the outside of the lighting apparatus with wiring.

The multi-position selective switch on the outside of the lighting apparatus includes a wall switch.

By changing the light emitting status of the multiple sets of light sources 22 by switching the wall switch for multiple times, there may be different light emitting angles.

Figure 5:
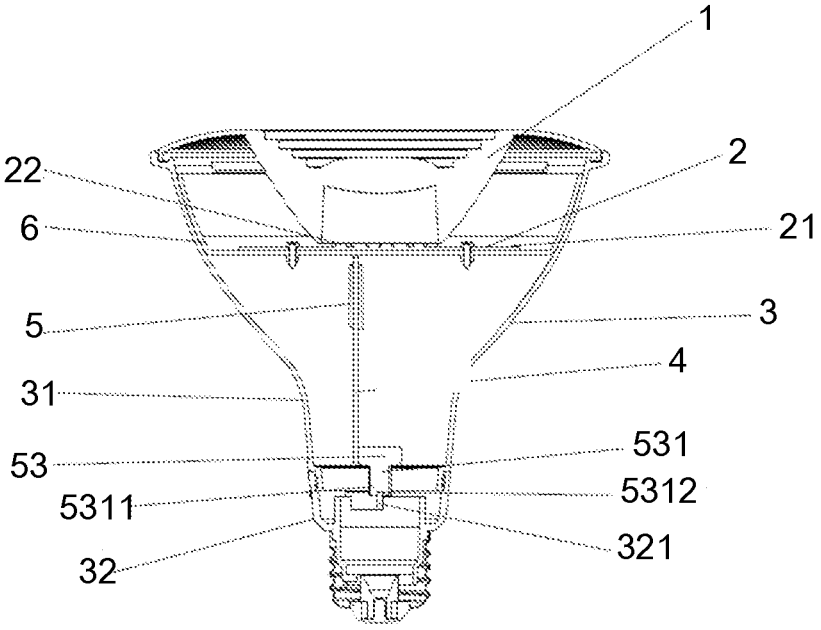
FIG. 5 is a cross sectional view of the lighting apparatus in a third embodiment.
Figure 6:
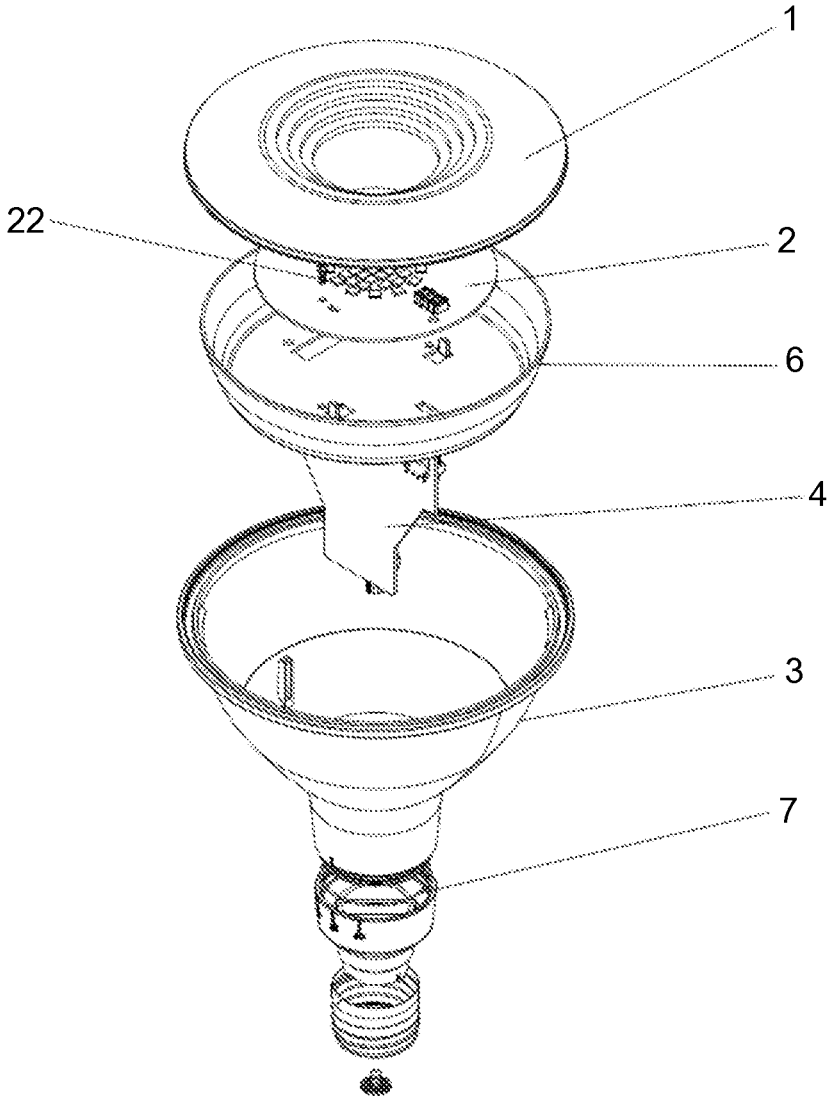
FIG. 6 is an exploded view the lighting apparatus in the third embodiment.

In the third embodiment, as illustrated in FIG. 5 and FIG. 6, the light emitting control module 5 includes a controller 51 and a switch module 53 connected to the controller 51.

When the switch module 53 is a knob switch module 531, the housing 3 may be a first housing 31 or a second housing 32.

The first housing 31 and the second housing 32 are rotatably connected.

The knob switch module 531 is set between the first housing 31 and the second housing 32.

And the switch position may be changed with the rotation between the first housing 31 and the second housing 32.

Then the light emitting status of the multiple sets of light sources 22 may be switched by changing the switch position of the knob switch module 531.

In preferable embodiment, the knob switch module 531 is fixed inside of the first housing 31.

On the knob switch module 531 has a knob 5311 for rotating. On the knob has a groove 5312. Inside of the second housing 32 has a cross bar 321 fixed to the groove 5312.

By rotating the first housing 31 and the second housing 32, the cross bar 321 may drive the knob 5311 to rotate to switch the switch position to control the light emitting status of the multiple sets of light sources 22.

In other embodiments, other ways of connection may be adopted to make rotating the first housing 31 and the second housing 32 and controlling the light emitting status of the multiple sets of light sources happen at the same time.

In addition, in this situation, between the first housing 31 and the second housing may be a water proof unit 7.

In preferable embodiment, the water proof unit 7 may use a water proof ring to avoid the water from getting into the lighting apparatus and affecting the device.

In other embodiments, the switch module 53 may be a push-button switch module or a toggle switch module.

The button of the push-button switch module or the toggle of the toggle switch module may be fixed to the housing 3. Then the luminance levels of the multiple sets of light sources may be changed by using the button or the toggle to switch among different switch positions.

Additionally, the controller 51 mentioned in the first to the third embodiments is preferably a single chip machine or other equipment with the function of data processing.

In the design of the multiple sets of light sources 22, the center of the multiple sets of light sources 22 is set the circular light source that is tightly arranged with minimum diameter.

And there are multiple sets of light sources 22 from the center to the peripheral.

Each set of the multiple sets of light sources 22 may be controlled individually.

In preferable embodiment, the multiple sets of light sources 22 include an inner circular light source, a middle circular light source, and an outer circular light source disposed in concentric circles.

There are at least three ways of illuminating. In the first way, the luminance level of the inner circular light source is 100%. The luminance level of the middle circular light source and the outer circular light source is 0%. And the light emitting angle is 25 degrees. In the second way, the luminance level of the inner circular light source is 28%. The luminance level of the middle circular light source is 72%. The luminance level of the outer circular light source is 0%. And the light emitting angle is 40 degrees. In the third way, the luminance level of the inner circular light source is 13%. The luminance level of the middle circular light source is 26%.

The luminance level of the outer circular light source is 61%. And the light emitting angle is 60 degrees. Adopting there three ways of illuminating may make the lighting apparatus switching among 25 degrees, 40 degrees, and 60 degrees with only one TIR lens happen.

There may be other ways of illuminating in other situations based on the needs.

Adjusting the luminance levels of the multiple sets of light sources 22 meets the needs of changing among different angles.

Adjusting the luminance level of the TIR lens makes the lighting apparatus switching among different angles happen. Then, the lighting apparatus may be applicable to multiple situations and have the minimal overall cost.

Adjusting the light emitting status of the multiple sets of light sources 22 in one TIR lens of the lighting apparatus makes the lighting apparatus switching among different angles happen. Then, the lighting apparatus may be applicable to multiple situations.

The appearance of the lens 1 of the lighting apparatus is as the same as the conventional PAR light. The lens of the lighting apparatus looks like the single-lens TIR lens. Users' acceptability is higher.

Other than that, the lighting apparatus has multiple control methods to switch the light emitting status of the multiple sets of light sources 22 and the light emitting angle of the lighting apparatus.

The lighting apparatus is easy to operate and convenient. And the cost of the situations that need multiple angles is lower.

Also, the lighting apparatus has good water proof effect. The light apparatus may avoid the damage that the outdoor sprinklers do to the inner electronic devices. The lighting apparatus is applicable to many situations and very reliable. And the lighting apparatus is good for large-scale promotion and application.

In FIG. 8A to FIG. 8E, different projected shapes are illustrated as examples. The multiple projected shapes may have different diameters.

Figure 8A:
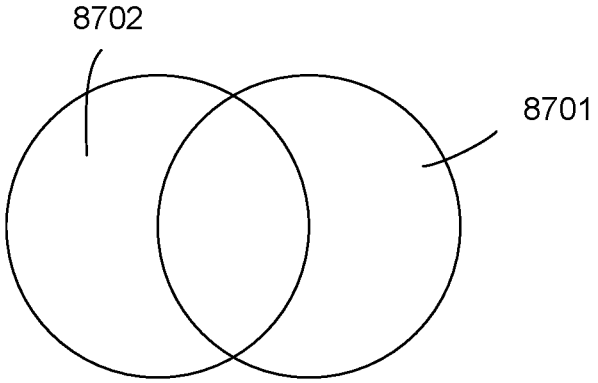
FIG. 8A shows a projected shape example.

In FIG. 8A, a first light pattern 8701 emitted by the first set of LED modules is partially overlapped with the second light pattern 8702 emitted by the second set of LED modules. This example shows that by adjusting the lens module, changing the light paths of the first set of LED modules and the second set of LED modules as well as arrangement of the first set of LED modules and the second set of LED modules, different projected shapes may be generated.

There may be more than two sets of LED modules in real designs.

Figure 8B:
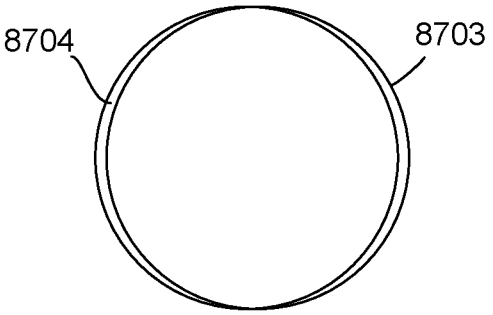
FIG. 8B shows another projected shape example.

In FIG. 8B, another projected shapes are illustrated, in which the first set of LED modules and the second set of LED modules emit light patterns 8703, 8704 substantially overlaps to each other. In such case, the driver may determine one set of LED modules to rest for a while for heat dissipation and uses the two sets of LED modules alternatively for providing illumination.

Figure 8C:
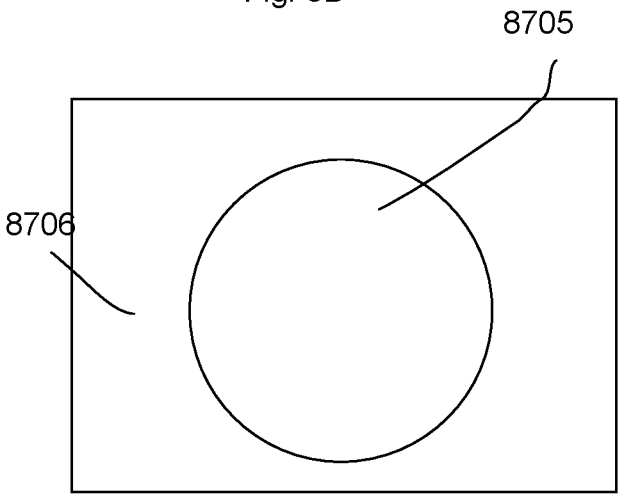
FIG. 8C shows another projected shape example.

In FIG. 8C, the first light pattern 8705 and the second light pattern 8706 have different geometric shapes.

Figure 8D:
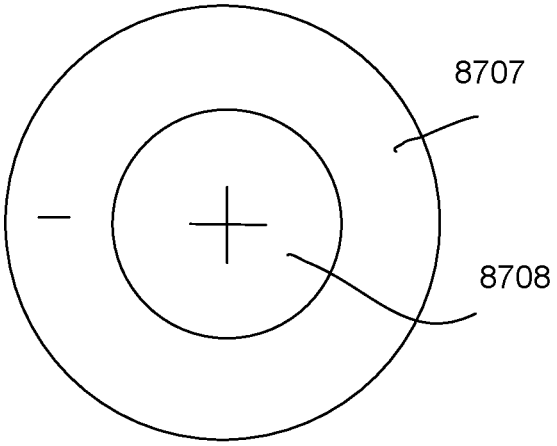
FIG. 8D shows another projected shape example.
Figure 8E:
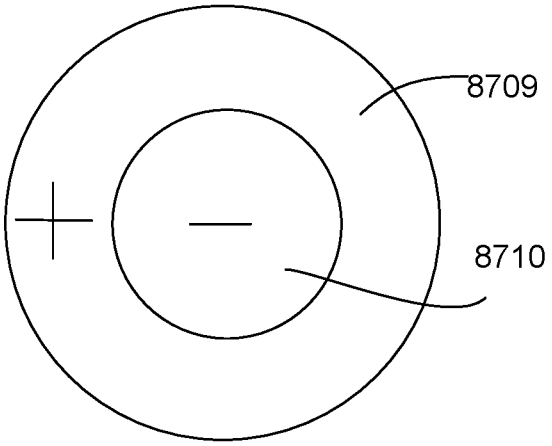
FIG. 8E shows another projected shape example.

In FIG. 8D and FIG. 8E, the first light pattern 8708, 8710 and the second light pattern 8707, 8709 may be adjusted by changing their light intensity or to say luminance level, luminance brightness, for changing the projected shape or to say projected light pattern. In FIG. 8D, the inner circle has stronger luminance level than the outer circle. In FIG. 8E, the inner circle has weaker luminance level than the outer circle.

Figure 9A:
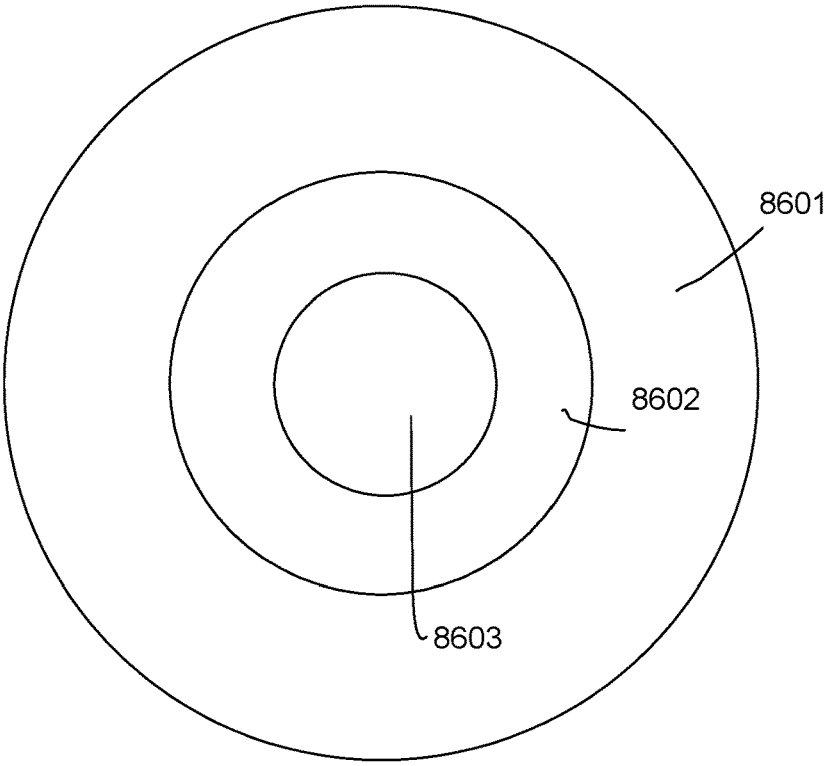
FIG. 9A shows another projected shape example.
Figure 9B:
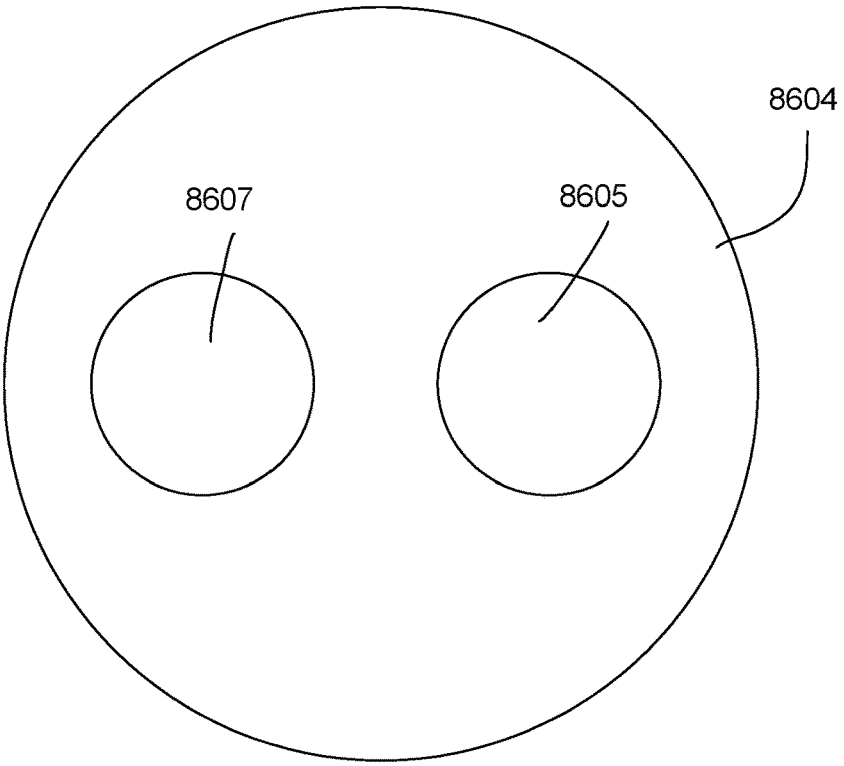
FIG. 9B shows another projected shape example.

FIG. 9A and FIG. 9B show an example of a projected shape formed by three light patterns from three sets of LED modules. In FIG. 9A, three circles of light patterns 8601, 8602, 8603 surround as concentric circles. In FIG. 9B, three sets of light patterns 8605, 8604, 8607.

In some embodiments, when the multiple projected shapes are different, an overall power out of the first set of LED modules and the second set of LED modules is kept substantially the same. Specifically, if a constant current is generated by the driver, the constant current is divided into two paths, one path supplying to the first set of LED modules and the other path supplying to the second set of LED modules. Therefore, if the first set of LED modules take 100% power in the first mode, the second set of LED modules are turned off in such mode. In a second mode when the first set of LED modules take 50% power, the second set of LED modules take another 50% of power. In a third mode when the first set of LED modules are turned off, the second set of LED modules take 100% of power. When the light paths of the first set of LED modules and the second set of LED modules are controllable by arranging the lens module and the positions for positioning the first LED modules and the second set of LED modules, as illustrated in FIG. 8A, FIG. 8B, FIG. 8C, FIG. 8D and FIG. 8E, the desired shapes may be achieved while the design of the driver is simplified, particularly when a fixed current is easier to be implemented.

In some embodiments, the second set of LED modules surround the first set of LED modules, the projected shape is decreased by turning off the second set of LED modules.

In some embodiments, a luminance level ratio between the first set of LED modules and the second set of LED modules is different providing different projected light patterns. Such example may be found in FIG. 8D and FIG. 8E in previous explanation.

In some embodiments, the driver controls only a portion of the first set of LED modules together with a portion of the second set of LED modules to emit light for providing a projected light pattern different from turning on all of the first set of LED modules and all of the second set of LED modules. Specifically, when the first set of LED modules are divided into three first subsets of LED modules, which are located at different positions, the three first subsets of LED modules may be controlled separately so as to turn on, to turn off, or to adjust luminance levels of the first subsets of LED modules. Such design may render more flexible changes even only using the first subsets of LED modules. In addition, when the second set of LED modules are divided into multiple subsets and operated separately as mentioned, the combinations increase to provide much more effect to be selected.

For example, FIG. 9D shows two light patterns 8607, 8605, which may be generated by two subsets of the first set of LED modules. In such design, two objects may be emphasized instead of only one, which provides much more flexibility than conventional Par light or spot lights.

Figure 11:
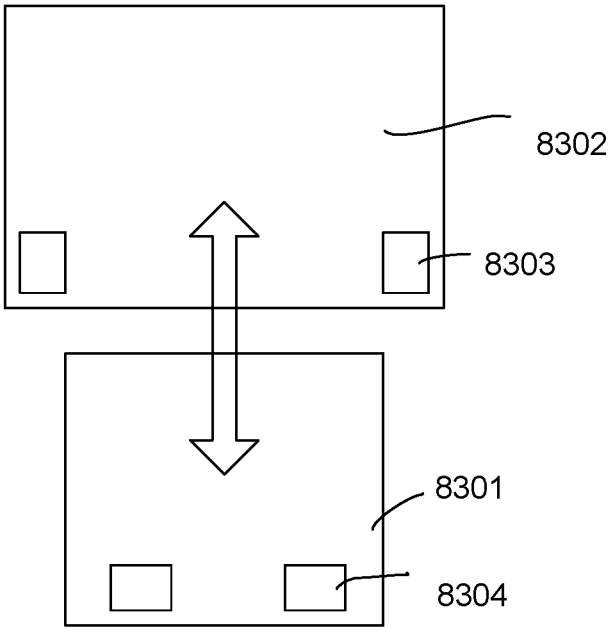
FIG. 11 shows a two module design.

In FIG. 11, the second set of LED modules 8303 are detachably attached to the first set of LED modules 8304. Specifically, the second set of LED modules 8303 are enclosed by a pluggable housing 8302, which may be plugged to a corresponding socket of a first housing 8301 which encloses the first set of LED modules 8304.

In FIG. 7, the lighting apparatus may also include a manual switch 8814 for controlling the driver 8810 to change the projected light shapes 8820.

In FIG. 7, the manual switch 8814 is positioned between a first housing 8812 and second housing 8813 of the lighting apparatus and operated by rotating the first housing 8812 with respect to the second housing 8813.

In some embodiments, multiple rotation patterns between the first housing and the second housing provide different settings for the driver to control the first set of LED modules and the second set of LED modules. For example, to rotate with a 90 degrees clockwise rotation may correspond to a first operation while to rotate with a 90 degrees counter-clockwise rotation may correspond to a second operation. More than one rotation being combined may also be corresponded to another mode for instructing the driver how to operate and drive the first set of LED modules and the second set of LED modules.

In FIG. 7, there is a triggering structure for switch a jumper 8815 on the driver 8810 when the first housing 8812 is rotated with respect to the second housing 8813.

In some other embodiments, the manual switch 8814 is adjusted when a first housing is shifted with respect to a second housing of the lighting apparatus.

In FIG. 7, the lighting apparatus may also include a lens module having a first lens portion 8807 facing to the first set of LED modules 8898 and a second lens portion 8806 facing to the second set of LED modules 8808, the first lens portion 8807 and the second lens portion 8806 having different optical parameters.

In some embodiments, the lens is a TIR lens.

In some embodiments, the first lens portion and the second lens portion provide different refraction angles respectively for the first set of LED modules and the second set of LED modules.

In some embodiments, the driver controls the first set of LED modules and the second LED modules to turn off for rest for a period of time alternatively to prevent overheating of the first set of LED modules and the second set of LED modules. For example, the first set of LED modules and the second set of LED modules are located in two half portions of the light source plate, and generate two output light patterns substantially the same, as the example of FIG. 8B, by the first set of LED modules and the second set of LED modules. The first set of LED modules and the second set of LED modules are controlled to rest, to cool down, for a period of time alternatively. In such way, particularly if the first set of LED modules and the second set of LED modules emit heat guided to different heat sinks, like two metal components, the first set of LED modules and the second set of LED modules may have longer life span because the LED modules are not operated constantly under high temperature.

In some embodiments, the first set of LED modules and the second of LED modules use different heat sinks to perform heat dissipation separately.

In some embodiments, the lighting apparatus may also include a water proof housing for enclosing the driver, the first set of LED modules and the second set of LED modules, wherein the lens module is plugged to the water proof housing and replaceable with another lens module to another lens module. This embodiment is sufficient to be illustrated in FIG. 7, where the components are divided into two portions, while the LED modules and driver circuits are integrated as a first module, which provides sufficient water proof and satisfies safe standard, e.g. sufficient isolation so that users are not electrically shocked. Meanwhile, the lens module is made as another module which may be detachably attach to the first module.

Figure 10:
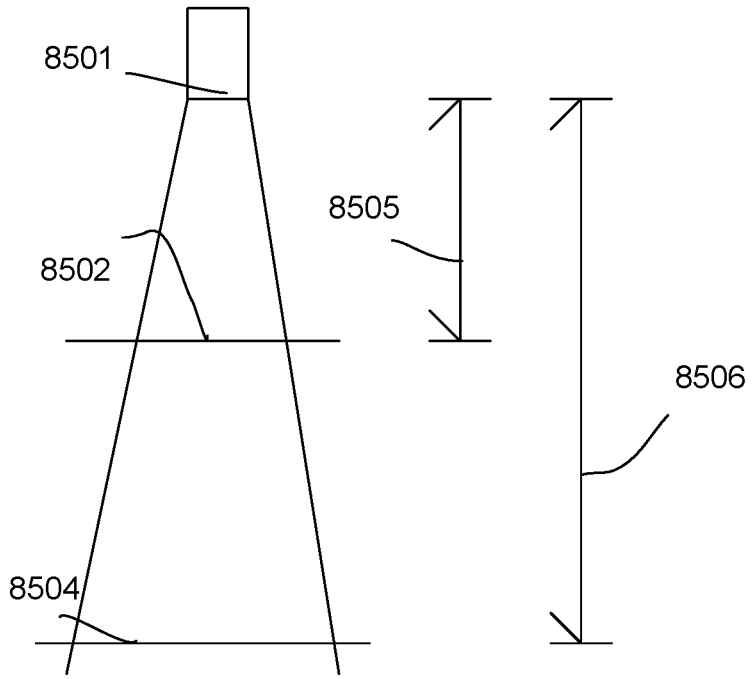
FIG. 10 shows a control method for different distances.

In FIG. 10, the lighting apparatus may also include a distance detector 8501, wherein the driver uses the distance detector 8501 to measure a distance between the lighting apparatus to the projected surface and uses the distance to determine how to control the first set of LED modules and the second set of LED modules. For example, the two distances 8505, 8506 may cause the same lighting apparatus to generate two different projected shapes 8502, 8504, at least with two different sizes. The driver uses the distance information to calculate or find from a stored table to control the first set of LED modules and the second set of LED modules accordingly so as to achieve desired effect. For example, when the lighting apparatus is far from the projected surface, a stronger current is provided to LED modules to render a similar luminance level compared with a closer projected surface.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a lens module;

a light source plate;

a first set of LED modules located at first positions of the light source plate and a second set of LED modules located at second positions of the light source plate;

a driver controlling the first set of LED modules and the second set of LED modules for generating a first output light pattern and a second output light pattern, the first light pattern and the second light pattern being mixed to generate one of multiple projected shapes on a projected surface controlled by the driver, wherein a second external boundary of the second light pattern surrounds a first external boundary of the first light pattern, wherein the second set of LED modules surround the first set of LED modules, the projected shape is decreased by turning off the second set of LED modules.

2. The lighting apparatus of claim 1, wherein the multiple projected shapes have different diameters.

3. The lighting apparatus of claim 1, wherein when the multiple projected shapes are different, an overall power out of the first set of LED modules and the second set of LED modules is kept substantially the same.

4. The lighting apparatus of claim 1, wherein a luminance level ratio between the first set of LED modules and the second set of LED modules is different providing different projected light patterns.

5. The lighting apparatus of claim 1, wherein the driver controls only a portion of the first set of LED modules together with a portion of the second set of LED modules to emit light for providing a projected light pattern different from turning on all of the first set of LED modules and all of the second set of LED modules.

6. The lighting apparatus of claim 1, wherein the second set of LED modules are detachably attached to the first set of LED modules.

7. The lighting apparatus of claim 1, further comprising a manual switch for controlling the driver to change the projected light shapes.

8. The lighting apparatus of claim 7, wherein the manual switch is positioned between a first housing and second housing of the lighting apparatus and operated by rotating the first housing with respect to the second housing.

9. The lighting apparatus of claim 8, wherein multiple rotation patterns between the first housing and the second housing provide different settings for the driver to control the first set of LED modules and the second set of LED modules.

10. The lighting apparatus of claim 8, wherein there is a triggering structure for switch a jumper on the driver when the first housing is rotated with respect to the second housing.

11. The lighting apparatus of claim 7, wherein the manual switch is adjusted when a first housing is shifted with respect to a second housing of the lighting apparatus.

12. The lighting apparatus of claim 1, further comprising a lens having a first lens portion facing to the first set of LED modules and a second lens portion facing to the second set of LED modules, the first lens portion and the second lens portion having different optical parameters.

13. The lighting apparatus of claim 12, wherein the lens is a TIR lens.

14. The lighting apparatus of claim 12, wherein the first lens portion and the second lens portion provide different refraction angles respectively for the first set of LED modules and the second set of LED modules.

15. The lighting apparatus of claim 1, wherein the driver controls the first set of LED modules and the second LED modules to turn off for rest for a period of time alternatively to prevent overheating of the first set of LED modules and the second set of LED modules.

16. The lighting apparatus of claim 15, wherein the first set of LED modules and the second of LED modules use different heat sinks to perform heat dissipation separately.

17. The lighting apparatus of claim 1, further comprising a water proof housing for enclosing the driver, the first set of LED modules and the second set of LED modules, wherein the lens module is plugged to the water proof housing and replaceable with another lens module to another lens module.

18. The lighting apparatus of claim 17, further comprising a water proof housing for enclosing the driver, the first set of LED modules and the second set of LED modules, wherein the lens module is plugged to the water proof housing and replaceable with another lens module to another lens module.

19. The lighting apparatus of claim 1, further comprising a distance detector, wherein the driver uses the distance detector to measure a distance between the lighting apparatus to the projected surface and uses the distance to determine how to control the first set of LED modules and the second set of LED modules.

* * * * *